US006907752B2

(12) United States Patent
Schroeder et al.

(10) Patent No.: US 6,907,752 B2
(45) **Date of Patent: *Jun. 21, 2005**

(54) CRYOGENIC LIQUID NATURAL GAS RECOVERY PROCESS

(75) Inventors: Scott Schroeder, Houston, TX (US); Kenneth Reddick, Houston, TX (US)

(73) Assignee: Howe-Baker Engineers, Ltd., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/614,458

(22) Filed: Jul. 7, 2003

(65) Prior Publication Data

US 2005/0005636 A1 Jan. 13, 2005

(51) Int. Cl.[7] ..... F25J 3/00
(52) U.S. Cl. ..... 62/620; 62/631
(58) Field of Search ..... 62/620, 625, 630, 62/631, 632

(56) References Cited

U.S. PATENT DOCUMENTS 3,405,530 A 10/1968 Denahan et al.
3,420,068 A * 1/1969 Petit ..... 62/623
3,837,821 A 9/1974 Biffoere et al.
4,689,063 A 8/1987 Paradowski et al.
5,114,451 A 5/1992 Rambo et al.
5,588,308 A 12/1996 Daugherty et al.
6,311,516 B1 * 11/2001 Key et al. ..... 62/619
6,564,579 B1 * 5/2003 McCartney ..... 62/620
6,604,380 B1 * 8/2003 Reddick et al. ..... 62/620
2002/0029585 A1 * 3/2002 Stone et al. ..... 62/620
2003/0029190 A1 * 2/2003 Trebble ..... 62/620
2004/0025535 A1 * 2/2004 Mak ..... 62/620

FOREIGN PATENT DOCUMENTS

WO PCT/US2004/004072 12/2004

* cited by examiner

*Primary Examiner*—William C. Doerrler
(74) *Attorney, Agent, or Firm*—McDonnell Boehnen Hulbert & Berghoff LLP

(57) ABSTRACT

A process for the recovery of natural gas liquids (NGL) (ethane, ethylene, propane, propylene and heavier hydrocarbons) from liquefied natural gas (LNG) is disclosed. The LNG feed stream is split with at least one portion used as an external reflux, without prior treatment, to improve the separation and recovery of the natural gas liquids (NGL).

13 Claims, 5 Drawing Sheets

CRYOGENIC LIQUID NATURAL GAS RECOVERY PROCESS

FIELD OF THE INVENTION

The present invention is directed toward the recovery of hydrocarbons heavier than methane from liquefied natural gas (LNG) and in particular to an improved process that provides for high-yield recovery of hydrocarbons heavier than methane while also producing a low BTU liquefied natural gas stream using minimal external heat supply.

BACKGROUND OF THE INVENTION

Natural gas typically contains up to 15 vol. % of hydrocarbons heavier than methane. Thus, natural gas is typically separated to provide a pipeline quality gaseous fraction and a less volatile liquid hydrocarbon fraction. These valuable natural gas liquids (NGL) are comprised of ethane, propane, butane, and minor amounts of other heavy hydrocarbons. In some circumstances, as an alternative to transportation in pipelines, natural gas at remote locations is liquefied and transported in special LNG tankers to appropriate LNG handling and storage terminals. The LNG can then be revaporized and used as a gaseous fuel in the same fashion as natural gas. Because the LNG is comprised of at least 80 mole percent methane it is often necessary to separate the methane from the heavier natural gas hydrocarbons to conform to pipeline specifications for heating value. In addition, it is desirable to recover the NGL because its components have a higher value as liquid products, where they are used as petrochemical feedstocks, compared to their value as fuel gas.

NGL is typically recovered from LNG streams by many well-known processes including "lean oil" adsorption, refrigerated "lean oil" absorption, and condensation at cryogenic temperatures. Although there are many known processes, there is always a compromise between high recovery and process simplicity (i.e., low capital investment). The most common process for recovering NGL from LNG is to pump and vaporize the LNG, and then redirect the resultant gaseous fluid to a typical industry standard turbo-expansion type cryogenic NGL recovery process. Such a process requires a large pressure drop across the turbo-expander or J.T. valve to generate cryogenic temperatures. In addition, such prior processes typically require that the resultant gaseous fluid, after LPG extraction, be compressed to attain the pre-expansion step pressure. Alternatives to this standard process are known and two such processes are disclosed in U.S. Pat. Nos. 5,588,308 and 5,114,451. The NGL recovery process described in the '308 patent uses autorefrigeration and integrated heat exchange instead of external refrigeration or feed turbo-expanders. This process, however, requires that the LNG feed be at ambient temperature and be pretreated to remove water, acid gases and other impurities. The process described in the '451 patent recovers NGL from a LNG feed that has been warmed by heat exchange with a compressed recycle portion of the fractionation overhead. The balance of the overhead, comprised of methane-rich residual gas, is compressed and heated for introduction into pipeline distribution systems.

Our invention provides another alternative NGL recovery process that produces a low-pressure, liquid methane-rich stream that can be directed to the main LNG export pumps where it can be pumped to pipeline pressures and eventually routed to the main LNG vaporizers. Moreover, our invention uses a portion of the LNG feed directly as an external reflux in the separation process to achieve high yields of NGL as described in the specification below and defined in the claims which follow. Our invention also provides a sharp degree of separation between the desirable and undesirable components, thereby reducing overall fuel and energy consumption of the process.

SUMMARY OF THE INVENTION

As stated, our invention is directed to an improved process for the recovery of NGL from LNG, which avoids the need for dehydration, the removal of acid gases and other impurities. A further advantage of our process is that it significantly reduces the overall energy and fuel requirements because the residue gas compression requirements associated with a typical NGL recovery facility are virtually eliminated. Our process also does not require a large pressure drop across a turbo-expander or J.T. value to generate cryogenic temperatures. This reduces the capital investment to construct our process by 30 to 50% compared to a typical cryogenic NGL recovery facility.

Our invention also limits the heat gain of the LNG stream through the process, which in turn provides additional downstream benefits. By minimizing the heat gain of the LNG, we ensure that the LNG is completely liquefied prior to entering the high-pressure pipeline pumps and that no vapor is present at the suction of the pumps. The reduced heat gain also allows us to operate our process at lower throughputs than the plant capacity while still producing completely liquefied LNG upstream from the high pressure pipeline pumps. In addition, the inventive process allows us to flash the low BTU LNG stream into a storage tank while creating a minimal volume of vapor. The inventive process also allows for the blending of boil-off vapor with the low BTU LNG, while still producing completely liquefied LNG upstream of the high pressure pumps.

In general, our process recovers hydrocarbons heavier than methane using low pressure liquefied natural gas (for example, directly from an LNG storage system) by using a recovery overhead from a deethanizer as a reflux stream to a recovery tower during the separation of a methane-rich stream from the heavier hydrocarbon liquids, thus producing high yields of NGL. In our invention the LNG feed stream to the recovery tower is heated to vaporize a portion of the stream, thereby minimizing the amount of fluid fed to the deethanizer, and the amount of external heating needed by the deethanizer, while also providing for high-yield recovery of the heavier hydrocarbons. The methane-rich overhead stream from the separation step is routed to the suction side of a low temperature, low head compressor to re-liquefy the stream. This re-liquefied LNG is then cross-heat exchanged with the feed stream and directed to main LNG export pumps. The liquid bottoms from the recovery tower are also partially vaporized by cross-exchange with the deethanizer overhead prior to being fed to the deethanizer to further limit the amount of external heat supply to the deethanizer.

In an alternate version of our invention, the methane-rich overhead from the recovery tower is cooled before being cross-exchanged with the feed stream. Possible variations of our process include rejecting the ethane while recovering the propane and heavier hydrocarbons, or similarly performing this split of any desired molecular weight hydrocarbon. In one of the possible variations of our process, propane recoveries are in the range of about 90 to 96% with 99+% butane-plus recovery.

In alternate versions of our invention, the overall recovery may be modified by providing reflux streams or additional feed streams to the recovery tower and/or the deethanizer. In one alternate version of our invention, the LNG feed stream to the recovery tower is split into a first split stream that is heated by cross-exchange with a compressed recovery tower overhead stream prior to being fed into the bottom of the recovery tower, and a second split stream that is fed directly into the top of the recovery tower. In a further alternate embodiment of our invention, the re-liquefied LNG stream is split into a first split stream that exits to the main LNG export pumps and a second split stream that is used as a reflux stream entering the top of the recovery tower. In yet a further alternate embodiment, the bottoms from the recovery tower is compressed and then split into a first split stream that is cross heat-exchanged with the overhead stream from the deethanizer prior to entering the deethanizer and a second split stream that is fed directly to the top of the deethanizer.

DETAILED DESCRIPTION OF THE INVENTION

Figure 1:
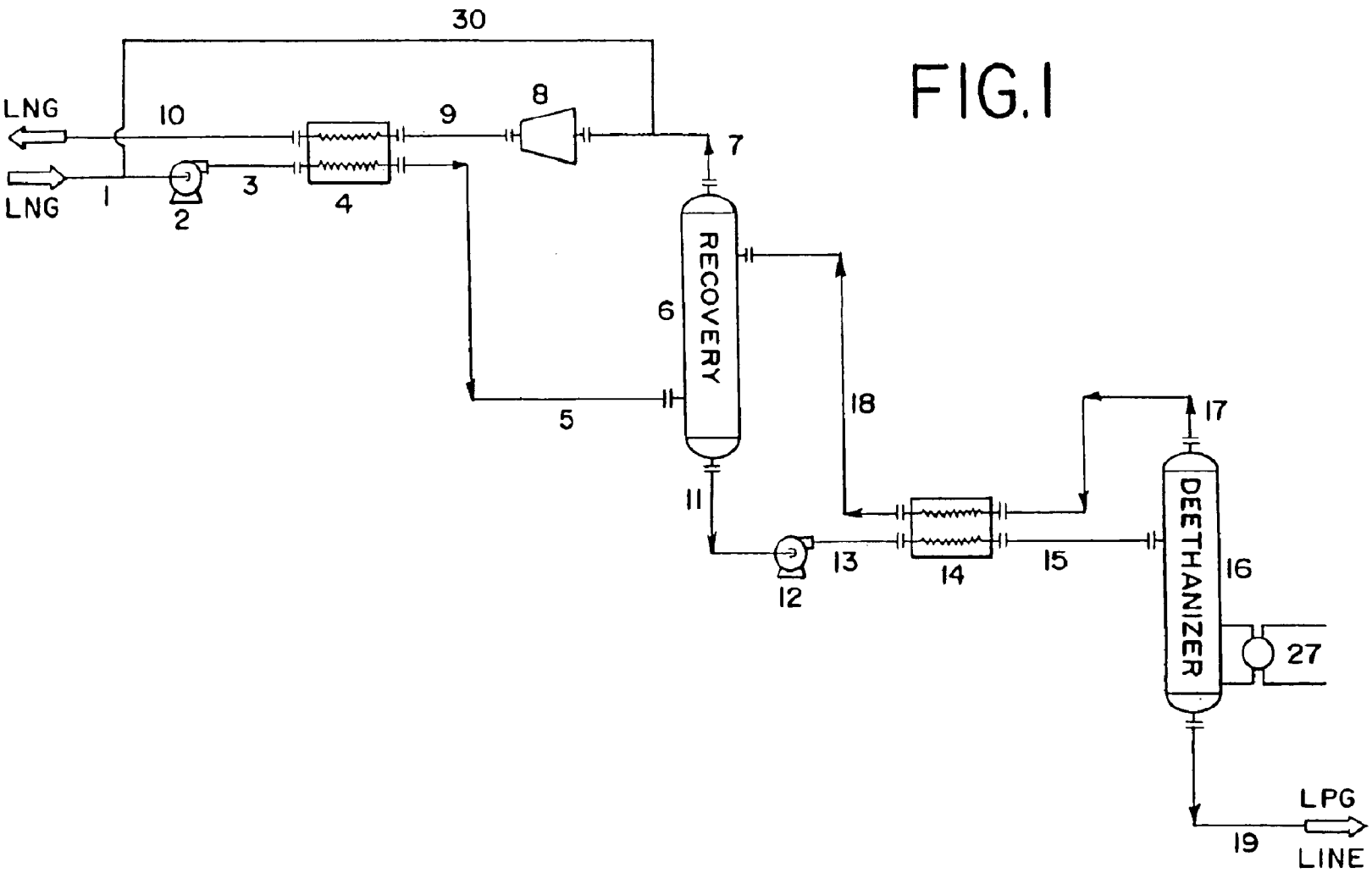
FIG. 1 is a schematic flow diagram of the method of the present invention.

Natural gas liquids (NGL) are recovered from low-pressure liquefied natural gas (LNG) without the need for external refrigeration or feed turboexpanders as used in prior processes. Referring to FIG. 1, process 100 shows the incoming LNG feed stream 1 enters pump 2 at very low pressures, typically in the range of 0–5 psig and at a temperature of less than −200° F. Pump 2 may be any pump design typically used for pumping LNG provided that it is capable of increasing the pressure of the LNG several hundred pounds to approximately 100–500 psig, preferably the process range of 300–350 psig. The resultant stream 3 from pump 2 is warmed and partially vaporized by cross-exchange in heat exchanger 4 with substantially NGL-free residue gas in stream 9 exiting the process 100. After being warmed and partially vaporized, the resultant stream 5 from heat exchanger 4 is fed to recovery tower 6. Recovery tower 6 may be comprised of a single separation process or a series flow arrangement of several unit operations routinely used to separate fractions of LNG feedstocks. The internal configuration of the particular recovery tower(s) used is a matter of routine engineering design and is not critical to our invention.

The overhead from recovery tower 6 is removed as a methane-rich stream 7 and is substantially free of NGL. The bottoms of recovery tower 6 is removed from process 100 through stream 11 and contains the recovered NGL product, which is further separated at a later point in the process to remove ethane. The methane-rich gas overhead in stream 7 is routed to the suction of a low temperature, low head compressor 8. Compressor 8 is needed to provide enough boost in pressure so that the exiting stream 9 maintains an adequate temperature difference in the main gas heat exchanger 4 to re-liquefy the methane-rich gas to form re-liquefied methane-rich (LNG) exit stream 10. Compressor 8 is designed to achieve a marginal pressure increase of about 75 to 115 psi, preferably increasing the pressure from about 300 psig to about 350–425 psig. The re-liquefied LNG in stream 10 is directed to the main LNG export pumps (not shown) where the liquid will be pumped to pipeline pressures and eventually routed to the main LNG vaporizers.

The bottoms 11 from recovery tower 6 enters pump 12 at temperatures ranging from −80 to −170° F. and pressures ranging from 100 to 500 psia and the resulting pressurized stream 13 is fed to heat exchanger 14, where it is heated to between −100 and 0° F. The resulting heated stream 15 is then fed to deethanizer 16. Deethanizeer 16 may be heated by a bottom reboiler or a side reboiler 27, if needed. The overhead stream 17 from deethanizer 16 is passed through heat exchanger 14 where it is used to heat the pressurized recovery tower bottoms stream 13. The cooled deethanizer overhead stream 18 is used a reflux stream for recovery tower 6. Hydrocarbons heavier than methane are removed from process 100 in the deethanizer bottoms stream 19.

In the descriptions of FIGS. 2 to 5, equivalent stream and equipment reference numbers are used to indicate identical equipment and stream compositions to those described previously in reference to FIG. 1.

Figure 2:
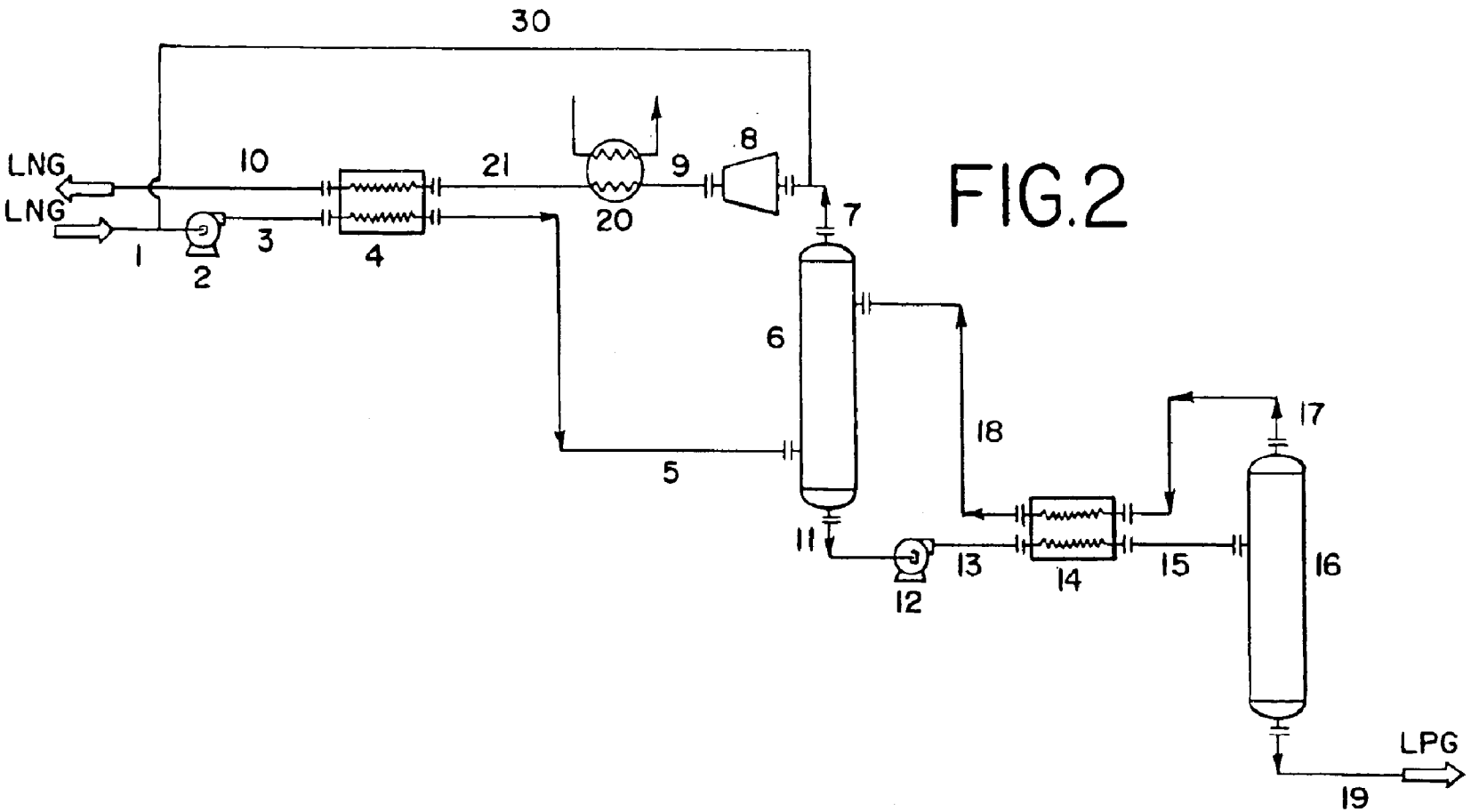
FIG. 2 is a schematic flow diagram of another method of the present invention.

As shown in FIG. 2, in an alternative embodiment of the invention, stream 9 exiting compressor 8 is cooled in cooler 20 and the resultant pre-chilled recovery tower overhead stream 21 is fed to heat exchanger 4, where it is cross-heat exchanged with the pressurized feed stream 3.

In alternate versions of our invention, the total recovery can be adjusted by providing reflux streams or additional feed streams to recovery tower 6 and/or deethanizer 16.

Figure 3:
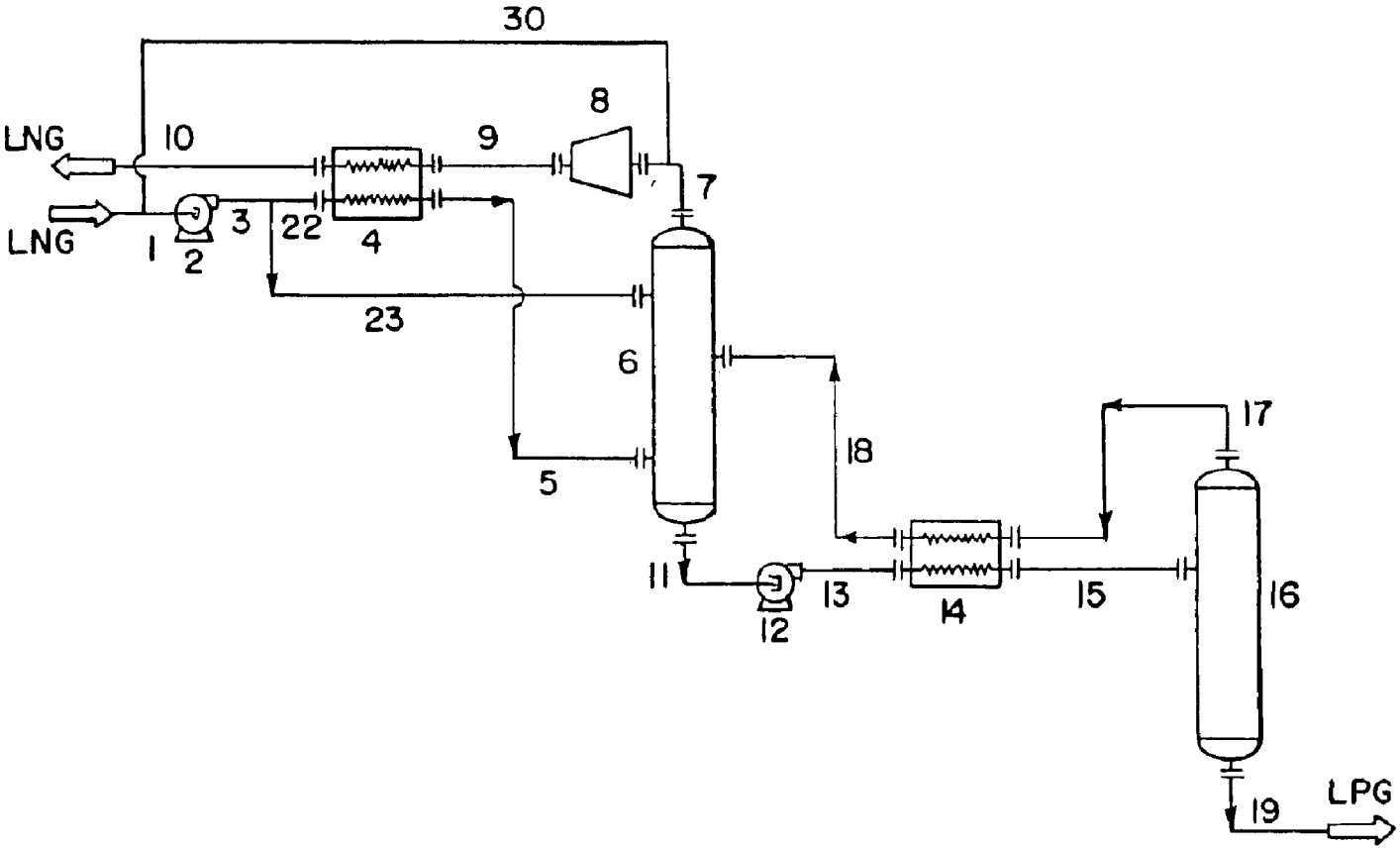
FIG. 3 is a schematic flow diagram of yet another method of the present invention.

FIG. 3 illustrates an alternate embodiment of our invention where the pressurized feed stream 3 exiting pump 2 is split into a first and second split streams, 22 and 23 respectively. First split stream 22 is cross-heat exchanged with compressed recovery tower overhead stream 9 in heat exchanger 4 before entering as a bottom feed stream 5 to recovery tower 6. Second split stream 23 is fed directly to the top of recovery tower 6.

Figure 4:
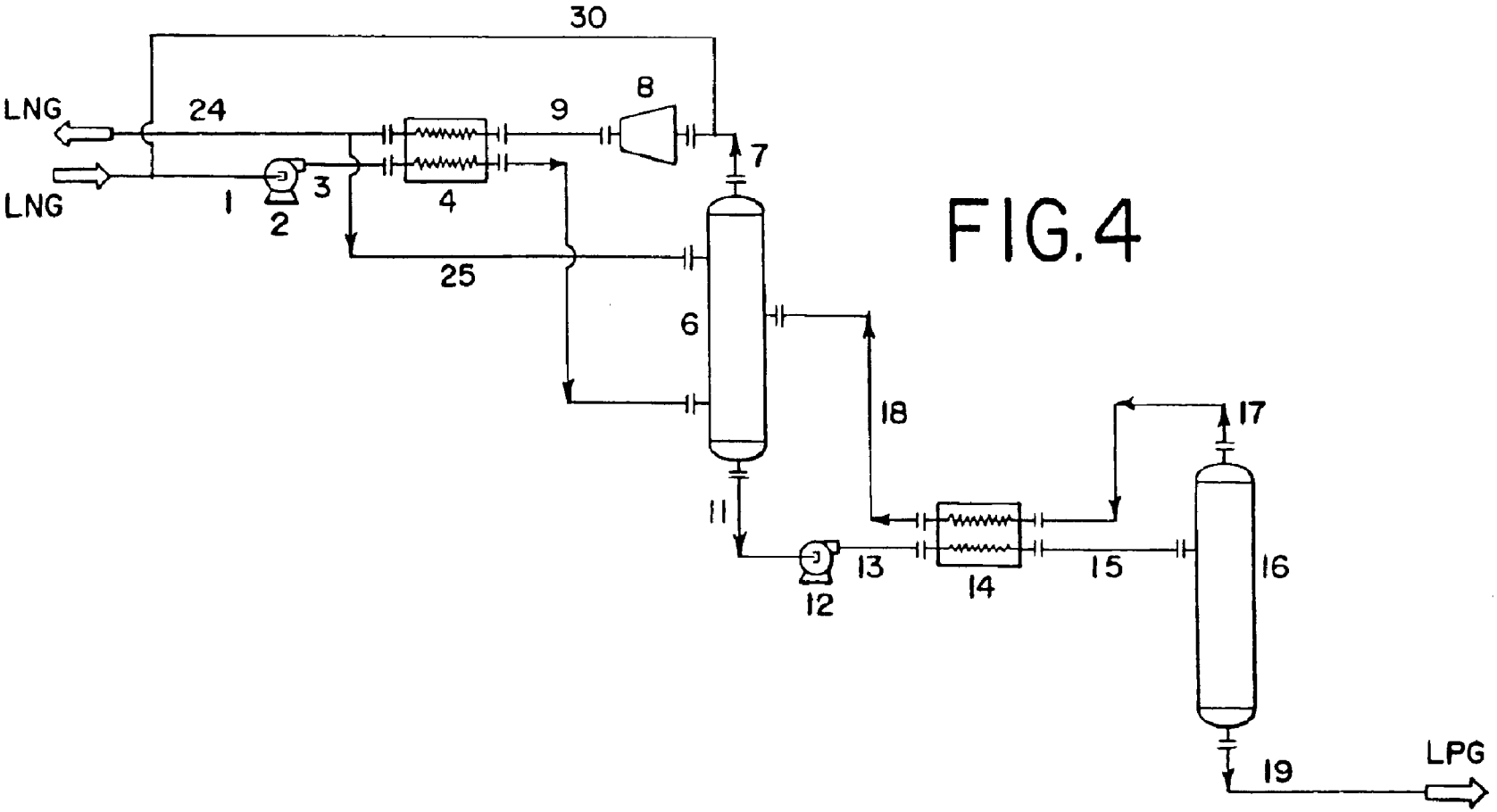
FIG. 4 is a schematic flow diagram of yet another method of the present invention.

As shown in FIG. 4, in a further alternate version of our invention, the compressed and re-liquefied overhead stream 10 from recovery tower 6 is split into first and second split streams, 24 and 25 respectively. First split stream 24 exits process 100 directly to the main export pumps (not shown). Second split stream 25 is fed as a reflux stream directly to the top of recovery tower 6.

Figure 5:
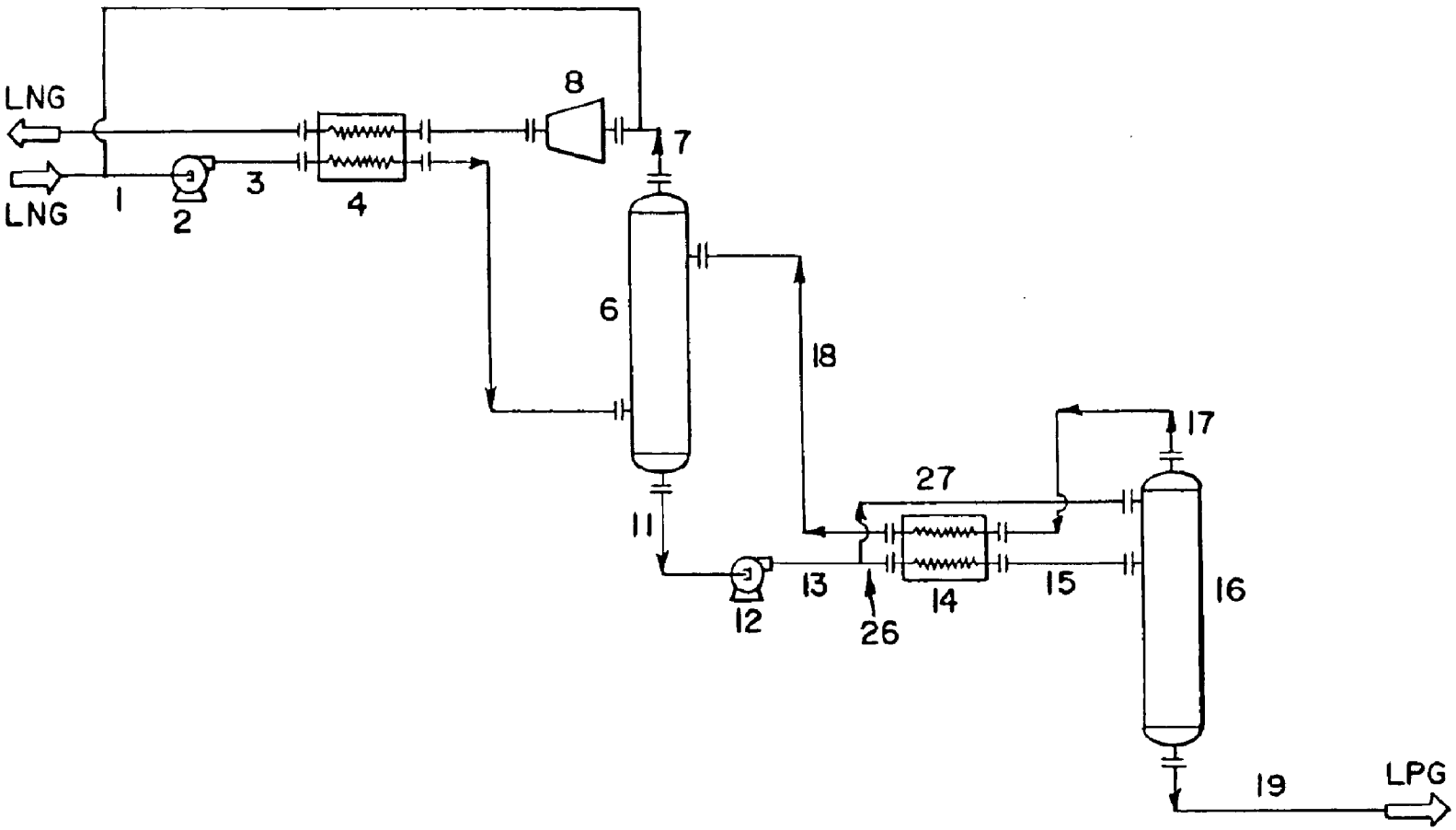
FIG. 5 is a schematic flow diagram of yet another method of the present invention.

FIG. 5 shows yet a further version of our invention, where the compressed bottoms stream 13 from recovery tower 6 is split into first and second split streams, 26 and 27 respectively. First split stream 26 is cross-heat exchanged with the overhead stream 17 from deethanizer 16 in heat exchanger 14 and then fed to the top of deethanizer 16. Second split stream 27 is fed directly to the top of deethanizer 16.

As shown in FIGS 1–5, the system optionally allows for combining boil-off vapor with the LNG feed stream upstream of high pressure pump 2.

The particular design of the heat exchangers, pumps, compressors and recovery towers is not critical to our invention; rather, it is a matter of routine engineering practice to select and size the specific unit operations to achieve the desired performance. Our invention lies with the unique combination of unit operations and the discovery of using untreated LNG as external reflux to achieve high levels of separation efficiency in order to recover NGL.

While we have described what we believe are the preferred embodiments of the invention, those knowledgeable in this area of technology will recognize that other and further modifications may be made thereto, e.g., to adapt the invention to various conditions, type of feeds, or other requirements, without departing from the spirit of our invention as defined by the following claims.

We claim:

1. A process of recovering hydrocarbons heavier than methane from liquefied natural gas (LNG) comprising, a) pumping liquid, low pressure LNG to a pressure of greater than 100 psia;

b) splitting the pressurized liquid LNG from step a) into first and second portions;

c) directing the first portion of pressurized liquid LNG from step b) to a cold box where it is heat exchanged to increase its temperature;

d) bypassing the cold box with the second portion of pressurized liquid LNG from step b) and directing it to a recovery tower as a first reflux;

e) directing the heat exchanged first portion of pressurized liquid LNG from step c) to a recovery tower where, in combination with the first reflux and a second reflux, a recovery tower overhead is produced along with a recovery tower bottoms;

f) pressurizing the recovery tower bottoms and cross heat exchanging the pressurized recovery tower bottoms with deethanizer overhead;

g) directing the cross heat exchanged pressurized recovery tower bottoms to a deethanizer;

h) removing hydrocarbons heavier than methane as deethanizer bottoms;

i) directing cross heat exchanged deethanizer overhead as the second reflux to the recovery tower; and j) removing the recovery tower overhead from the recovery tower and compressing the recovery tower overhead prior to introduction into the cold box and heat exchanging with the first portion of pressurized liquid LNG to produce a re-liquefied pressurized LNG.

2. The process of claim 1 further comprising the step of heating and recirculating the deethanizer bottoms stream.

3. The process of claim 1 further characterized in that a boil-off vapor is combined with the recovery tower overhead.

4. A process of recovering hydrocarbons heavier than methane from liquefied natural gas (LNG) comprising, a) pumping liquid, low pressure LNG to a pressure of greater than 100 psia;

b) directing the pressurized liquid LNG from step a) to a cold box where it is heat exchanged to increase its temperature;

c) directing the heat exchanged pressurized liquid LNG from step b) to a recovery tower where, in combination with a first and second reflux, a recovery tower overhead is produced along with a recovery tower bottoms;

d) pressurizing the recovery tower bottoms and cross heat exchanging the pressurized recovery tower bottoms with deethanizer overhead;

e) directing the cross heat exchanged pressurized recovery tower bottoms to a deethanizer;

f) removing hydrocarbons heavier than methane as deethanizer bottoms;

g) directing cross heat exchanged deethanizer overhead as a second reflux to the recovery tower;

h) removing the recovery tower overhead from the recovery tower and compressing the recovery tower overhead prior to introduction into the cold box and heat exchanging with the first portion of pressurized liquid LNG to produce a re-liquefied pressurized LNG; and i) separating a portion of the re-liquefied pressurized LNG for use as the first reflux.

5. The process of claim 4 further comprising the step of heating and recirculating the deethanizer bottoms.

6. The process of claim 4 further characterized in that a boil-off vapor is combined with the recovery tower overhead.

7. A process of recovering hydrocarbons heavier than methane from liquefied natural gas (LNG) comprising, a) pumping liquid, low pressure LNG to a pressure of greater than 100 psia;

b) directing the pressurized liquid LNG from step a) to a cold box where it is heat exchanged to increase its temperature;

c) directing the heat exchanged pressurized liquid LNG from step b) to a recovery tower where, in combination with a reflux, a recovery tower overhead is produced along with a recovery tower bottoms;

d) pressurizing the recovery tower bottoms and cross heat exchanging the pressurized recovery tower bottoms with deethanizer overhead;

e) directing the cross heat exchanged pressurized recovery tower bottoms to a deethanizer;

f) removing hydrocarbons heavier than methane as deethanizer bottoms;

g) directing cross heat exchanged deethanizer overhead as the flux to the recovery tower; and h) removing the recovery tower overhead from the recovery tower and compressing the recovery tower overhead prior to introduction into the cold box and heat exchanging with the first portion of pressurized liquid LNG to produce a re-liquefied pressurized LNG.

8. The process of claim 7 further comprising the step of heating and recirculating the deethanizer bottoms.

9. The process of claim 7 further characterized in that a boil-off vapor is combined with the recovery tower overhead.

10. The process of claim 7 further characterized in that the compressed recovery tower overhead is pre-chilled prior to introduction into the cold box.

11. A process of recovering hydrocarbons heavier than methane from liquefied natural gas (LNG) comprising, a) pumping liquid, low pressure LNG to a pressure of greater than 100 psia;

b) directing the pressurized liquid LNG from step a) to a cold box where it is heat exchanged to increase its temperature;

c) directing the heat exchanged pressurized liquid LNG from step b) to a recovery tower where, in combination with a reflux, a recovery tower overhead is produced along with a recovery tower bottoms;

d) pressurizing the recovery tower bottoms e) separating the pressurized recovery bottoms into a first and second portion f) cross heat exchanging the first portion of pressurized recovery tower bottoms with deethanizer overhead and directing the cross heat exchanged pressurized recovery tower bottoms to a deethanizer;

g) directing the second portion of pressurized recovery tower bottoms without heat exchanging to the deethanizer as reflux;

h) removing hydrocarbons heavier than methane as deethanizer bottoms;

i) directing cross heat exchanged deethanizer overhead as the flux to the recovery tower; and j) removing the recovery tower overhead from the recovery tower and compressing the recovery tower overhead prior to introduction into the cold box and heat exchanging with the first portion of pressurized liquid LNG to produce a re-liquefied pressurized LNG.

12. The process of claim 11 further comprising heating and recirculating the deethanizer bottoms.

13. The process of claim 11 further characterized in that a boil-off vapor is combined with the recovery tower overhead.

* * * * *